US005143107A

United States Patent [19]

Kelley

[11] Patent Number: 5,143,107

[45] Date of Patent: Sep. 1, 1992

[54] RAINING UMBRELLA

[76] Inventor: Jean M. Kelley, 2415 Parkland Dr., Florence, S.C. 29501

[21] Appl. No.: 621,036

[22] Filed: Nov. 30, 1990

[51] Int. Cl.[5] ..... A45B 3/00

[52] U.S. Cl. ..... 135/16; 135/31; 239/276; 239/289; 472/65; 472/81

[58] Field of Search ..... 135/16, 19, 20.2, 31; 446/483; 239/289, 276, 562, 569, 581.1; 472/117, 128, 65, 81

[56] References Cited

U.S. PATENT DOCUMENTS

| | | | |
|---|---|---|---|
| 2,625,946 | 1/1953 | Kaston et al. | 135/20.2 |
| 2,727,366 | 12/1955 | Hagen | 135/16 X |
| 2,950,063 | 8/1960 | Ripley, Jr. | 239/562 X |
| 2,954,932 | 10/1960 | Albano | 472/128 X |
| 3,170,171 | 2/1965 | Mayhew et al. | 472/128 X |
| 3,363,268 | 1/1968 | Friedlander | 472/128 X |
| 3,539,181 | 11/1970 | Larsen | 472/117 |
| 3,863,661 | 2/1975 | Aburto | 135/20.2 |
| 3,876,151 | 4/1975 | Katva | 239/562 X |
| 4,205,785 | 6/1980 | Stanley | 472/128 X |
| 4,785,976 | 11/1988 | Bennie et al. | 239/581.1 X |
| 4,870,983 | 10/1989 | Wang | 135/20.2 |
| 4,925,099 | 5/1990 | Owen | 239/289 |
| 5,000,384 | 3/1991 | Arnold | 239/289 X |

FOREIGN PATENT DOCUMENTS

| | | | |
|---|---|---|---|
| 2808635 | 9/1979 | German Democratic Rep. | 136/16 |

*Primary Examiner*—David A. Scherbel
*Assistant Examiner*—Lan Mai
*Attorney, Agent, or Firm*—Louis T. Isaf

[57] ABSTRACT

A raining umbrella is provided as an outdoor play toy for children. Water from a hose flows up through the umbrella handle and sprays out through holes in the spokes which support the umbrella canopy to create "rain" beneath the umbrella.

12 Claims, 4 Drawing Sheets

RAINING UMBRELLA

FIELD OF THE INVENTION

This invention relates generally to toys for children, and particularly to water toys.

BACKGROUND OF THE INVENTION

Many toys capitalize on a child's natural enjoyment of playing in and around water. Water parks have been enormously popular in recent years and offer evidence of how children love to play in water, and the more different avenues for doing so, the better. However, it can be burdensome in many ways for parents to make frequent trips with their families to large public amusement parks of this type.

Most everyone has seen children playing in the rain or under a sprinkler on a hot summer afternoon. But, children also need diversity in their activities, and many soon grow tired of simple sprinklers, seeking other pastimes which are more likely to challenge their innate creativity.

Several types of umbrellas which create "rain" to fall on top of the umbrella have been found in the patent literature. An early example is provided by Askin, U.S. Pat. No. 1,020,071, which is an umbrella for theatrical purposes. This device has a water filled bulb near the umbrella handle which can be squeezed to force the water up a tube and out through a nozzle. The water exits the nozzle in a fine mist which falls back on the top surface of the umbrella to create an illusion of rain. Hagen, U.S. Pat. No. 2,727,366, provides a means for attaching a hose fed sprinkler above an umbrella to create a water cooled environment which will at the same time keep anyone under the umbrella dry. Finally Altsheler, U.S. Pat. No. 3,038,483 discloses a combination umbrella and water pistol. This invention has a water pistol mounted inside an umbrella which fires through the tip of the umbrella. The umbrella can be opened to provide a shield after squirting someone with the pistol. These inventions are similar in that each includes a system built into an umbrella for delivery of a stream of water above the umbrella canopy.

SUMMARY OF THE INVENTION

The present invention provides a toy which can be carried easily by a child, and which looks like a normal umbrella upon first glance. However, this umbrella is not ordinary, for although it could be used to provide shelter from the elements, the "rain" which it creates falls under the umbrella, soaking anyone beneath it.

Different embodiments of the "raining" umbrella create "rain" in different ways. In the preferred embodiment, a reservoir at the top of the umbrella is filled with water which flows through a valve and out through perforated tubes attached to the spokes of the umbrella canopy. A hose can also be attached at the base of the umbrella handle. Water flows up through the interior of the handle, passes through the valve, and out into tubes attached to the spokes of the umbrella canopy. In another embodiment the bottom of the reservoir is perforated and has a similarly perforated panel mounted below it. The perforated panel is accessible from beneath the umbrella and can be rotated to align the panel perforations with those in the reservoir bottom and thus allow water in the reservoir to drip out beneath the umbrella.

It is therefore an object of the present invention to provide an umbrella which creates "rain" to fall upon anyone beneath the umbrella.

Another object of the present invention is to provide a toy which can be used out of doors to provide shade and a cooling shower for the user.

Another object of the present invention is to provide a "raining" umbrella toy which will provide hours of fun, pleasure and entertainment for children.

These and other objects, features and advantages of the present invention will become apparent upon reading and understanding this specification.

DETAILED DESCRIPTION OF THE DRAWINGS

Figure 1:
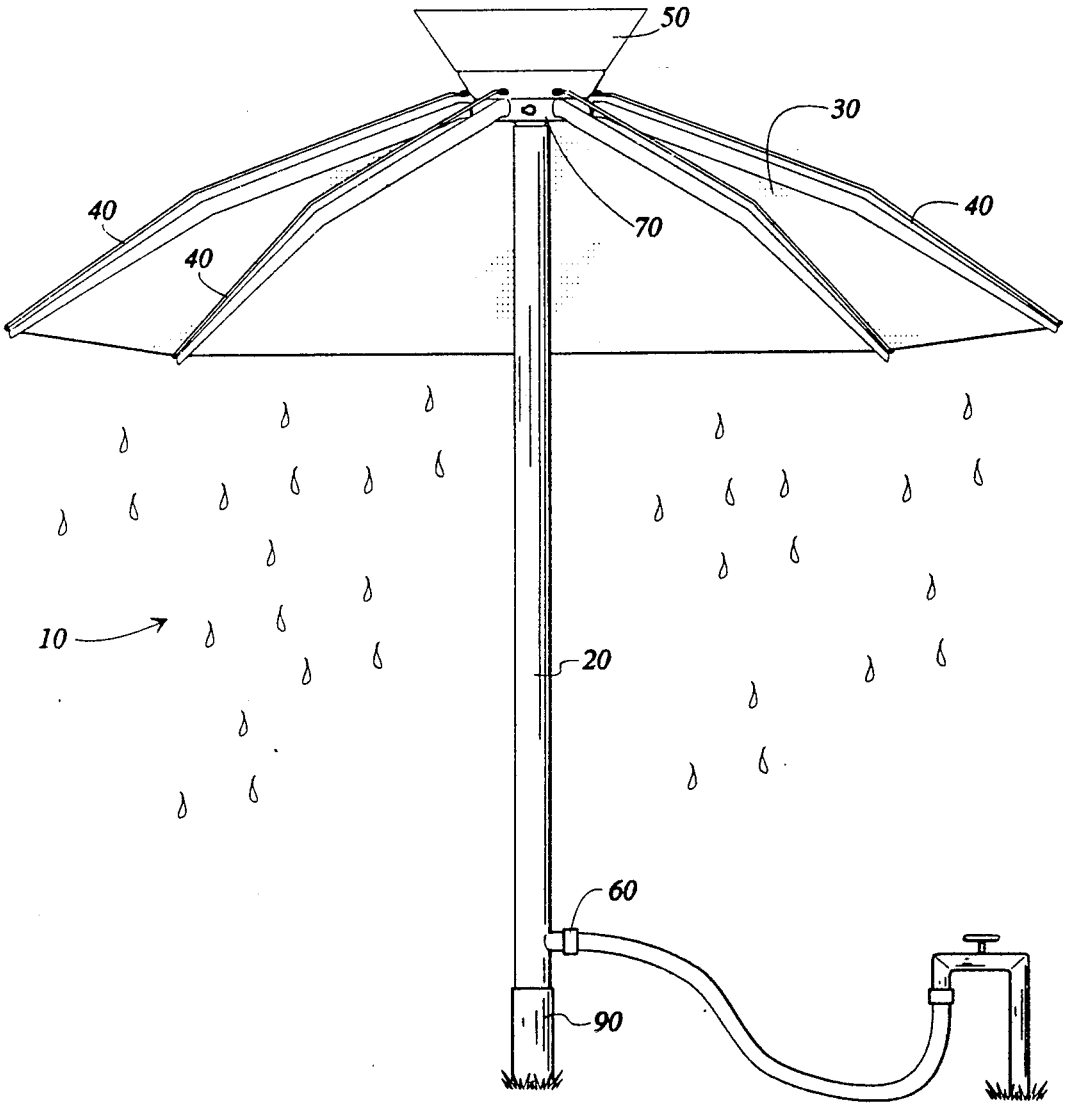
FIG. 1 shows a partially cut away view of the preferred embodiment the present invention.

Referring now to the drawings, in which like numerals represent like components throughout the several views, FIG. 1 depicts the preferred embodiment "raining" umbrella 10 of the present invention. This preferred embodiment "raining" umbrella includes a support stand 90, handle 20, canopy 30, a plurality of support spokes 40, reservoir 50, hose attachment 60 and nozzle 70.

Figure 2:
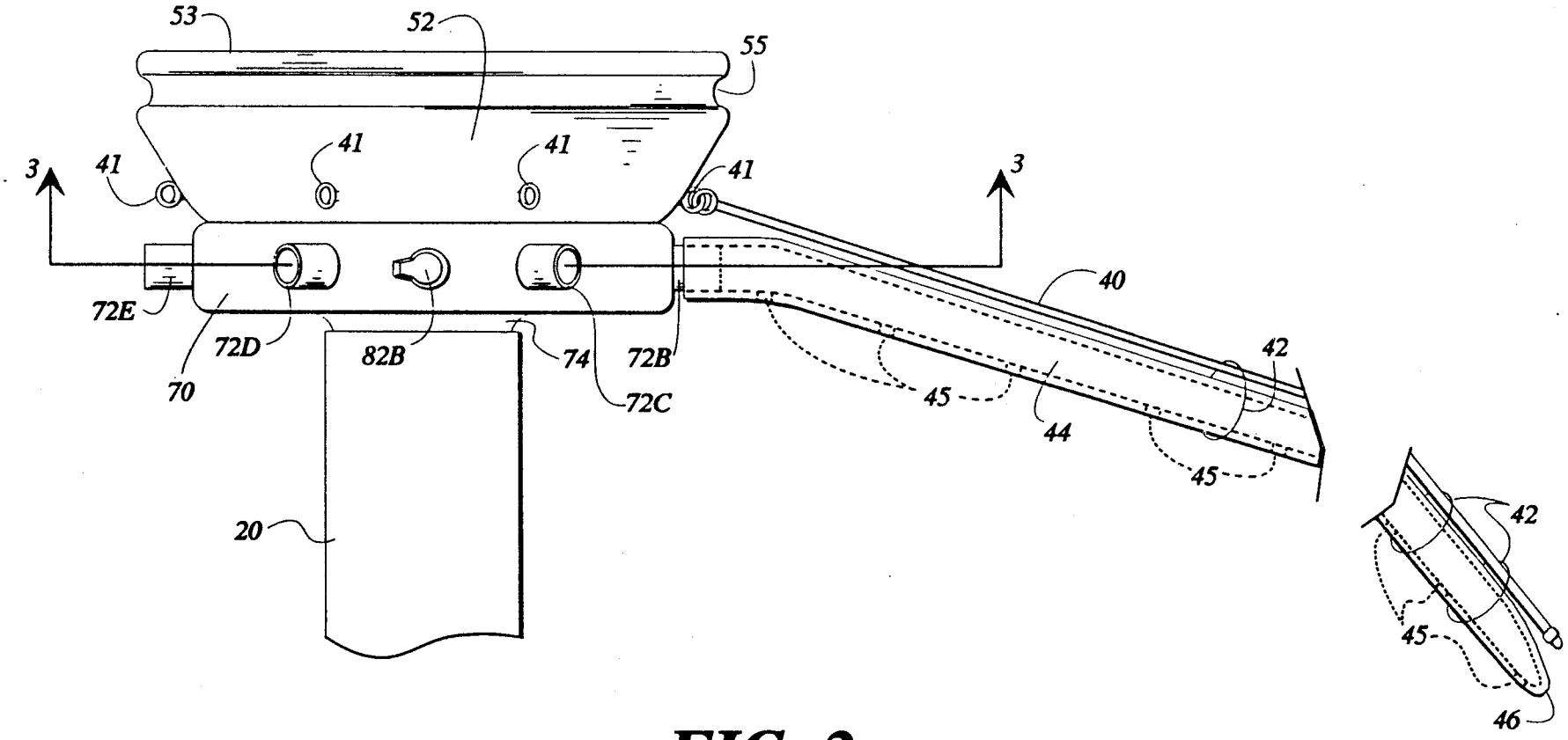
FIG. 2 is a detailed view of the valve of FIG. 1.

FIG. 2 shows the nozzle 70 of the preferred embodiment in greater detail as including a base 74 for attaching the nozzle 70 to the handle 20. A plurality of hollow nozzle projections 72B–72E are shown here also. The upper portion of the nozzle includes a reservoir attachment 52, which includes a plurality of spoke attachment rings 41, rim 53 and canopy grip channel 55. A bowl shaped reservoir 50 is attached to reservoir attachment 52 along rim 53. Only one tube 44 is shown (attached at one end to nozzle projection 72B) here, for clarity of illustration, although in practice there will be a tube attached to each nozzle projection. The tube 44 has a sealed end 46 and includes a plurality of perforations 45 along one side. The tube 44 and support spokes 40 are connected by tube support ties 42. The nozzle 70 also includes a valve mechanism which can be partially seen here as valve knob 82B.

Figure 3:
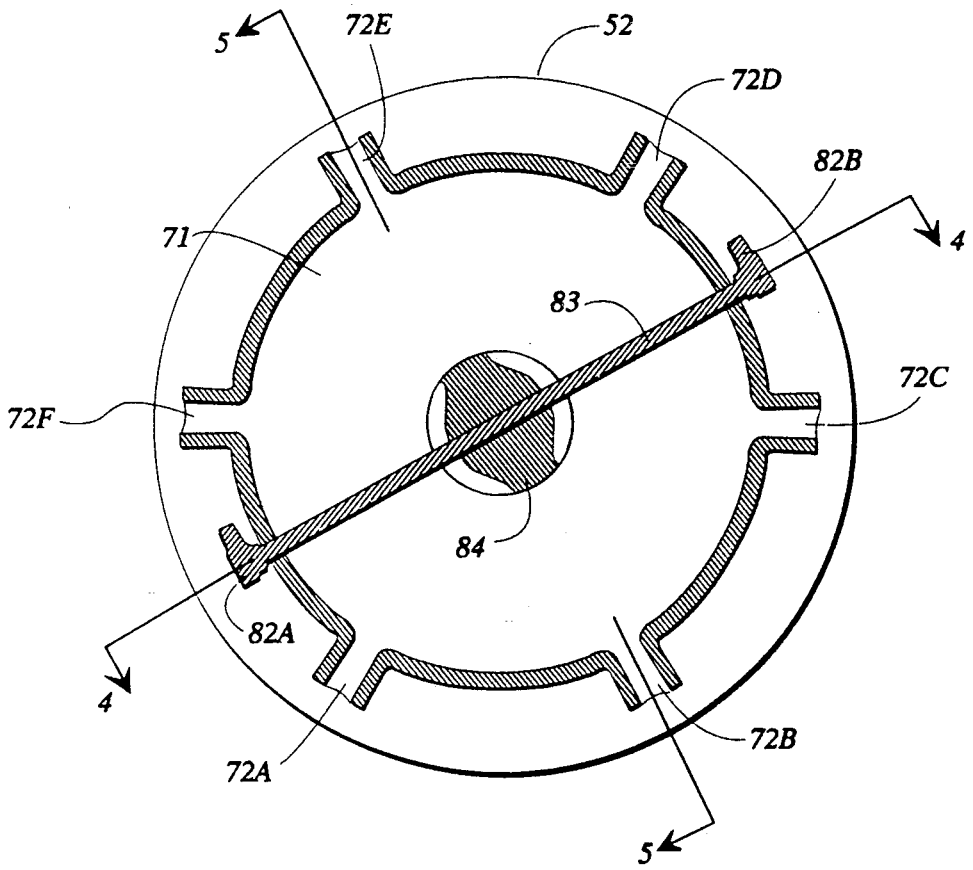
FIG. 3 is a cross sectional view of the valve of FIG. 2 taken along line 3—3 of FIG. 2.

The valve mechanism of the preferred embodiment is shown in more detail in the sectional view of FIG. 3 as including valve knobs 82A and 82B, valve axle 83 and spherical valve plug 84. The valve knobs 82A and 82B and valve plug 84 are rigidly attached to valve axle 83. However, the valve axle is rotatably mounted to the walls of nozzle 70.

Figure 4:
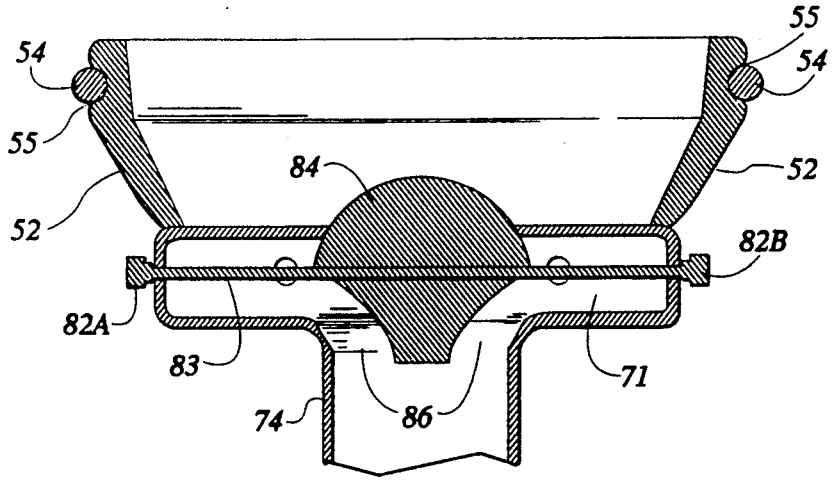
FIG. 4 is a cross sectional view of the valve of FIG. 2 taken along line 4—4 of FIG. 3.

A side view of the valve mechanism of FIG. 3 is shown in FIG. 4, which shows how a valve channel 86 is defined in two areas of the valve plug 84, while the opposite half of the valve plug is solid. The valve channel 86 is designed to create a passageway between the nozzle interior 71 and either the reservoir attachment 52 or the nozzle base 74. As shown in FIG. 4, the valve plug is positioned to create a passageway between the nozzle interior 71 and the nozzle base 74. However, as will be explained later, the valve knobs 82 can be rotated 180° to reposition the solid half of the valve plug 84 so that it blocks the opening between the nozzle interior 71 and the nozzle base 74 and creates a passageway between the nozzle interior and the reservoir attachment 52. FIG. 4 also shows canopy grip ring 54 positioned in canopy grip channel 55. When fully assembled, the upper edge of canopy 30 is placed in canopy grip channel 55 and canopy grip ring 54 is positioned as shown to secure the canopy between the canopy grip ring and channel.

Figure 5:
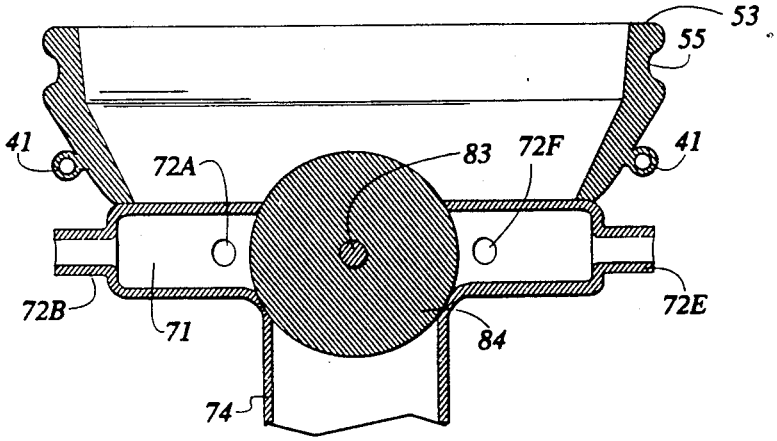
FIG. 5 is a cross sectional view of the valve of FIG. 2 taken along line 5—5 of FIG. 3.

FIG. 5 shows a sectional view of the valve mechanism of the preferred embodiment taken through the center of the valve plug 84 in a direction perpendicular to the valve axle 83. This view illustrates the center section of the valve plug 84, which is circular to allow smooth rotation of the plug about the plug axis.

Figure 6:
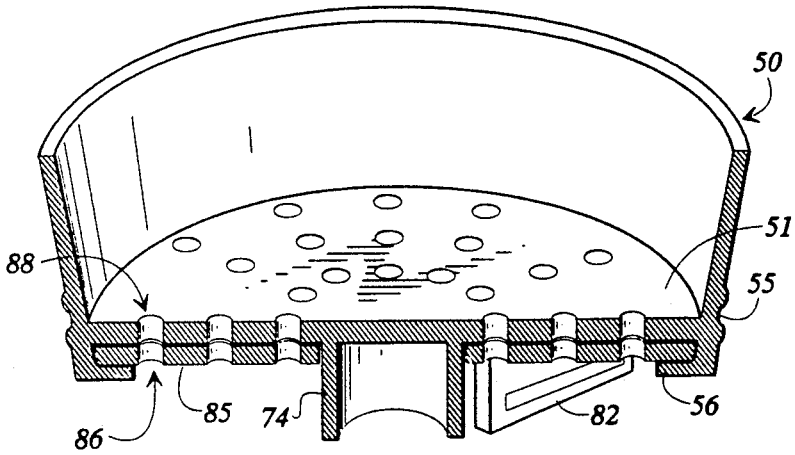
FIG. 6 shows a cross sectional detailed view of another embodiment of the present invention.

An alternate embodiment reservoir 50 and valve mechanism is shown in FIG. 6. This embodiment includes a reservoir 50 which has a large bottom panel 51. The reservoir bottom panel 51 is pierced by a plurality of regularly spaced reservoir channels 88. A nozzle base 74 is mounted to the center of the bottom surface of the reservoir bottom panel 51. A circular valve plug panel 85 is rotatably mounted below reservoir bottom panel 51 and includes a plurality of valve channels 86 which are spaced to allow alignment with reservoir channels 88. The valve plug panel 85 of this embodiment is held in place by a reservoir clip 56 attached to the bottom perimeter of the reservoir 50. A valve knob 82 is attached to the exposed side of the valve plug panel 85 to facilitate rotation of the valve plug panel and control alignment of valve channels 86 with reservoir channels 88. When these channels are aligned water from the reservoir 50 is allowed to drip out beneath the umbrella to create "rain".

Use

In the preferred embodiment shown in FIG. 1, the handle 20 and nozzle 70 have at least partially hollow interiors. During use, support stand 90 is planted vertically in the ground, the lower end of handle 20 is inserted into the support stand 90 and a garden hose is connected to the hose attachment 60. Water flowing from the garden hose will enter the hollow interior of the handle 20 and be constrained to flow up (according to the orientation shown in FIG. 1) the handle 20 to nozzle 70. When the valve mechanism is positioned as shown in FIGS. 2–4 the water will pass from nozzle base 74, through valve channel 86, and into the nozzle interior 71 (see FIG. 4).

Figure 7:
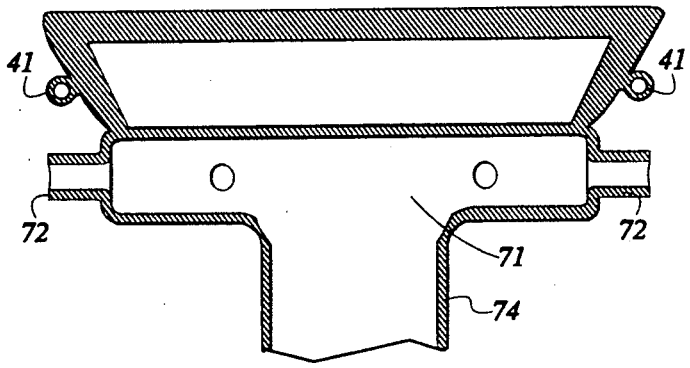
FIG. 7 shows a cross sectional detailed view of another embodiment of the present invention.

As more water flows into nozzle 70 through valve channel 86 some water will begin to flow out through nozzle projections 72 and into tubes 44. Water inside tubes 44 will drip through tube perforations 45, creating "rain" under the umbrella. Valve 80 may be eliminated in an alternate embodiment shown in FIG. 7, to produce "rain" whenever water is flowing into handle 20 through hose attachment 60.

When valve knob 82B is rotated 180° from the orientation shown in FIG. 2, the valve plug 84 will be inverted. This will block the passage between the nozzle base 74 and nozzle interior 71 and stop the flow of water from handle 20. At the same time a passage is opened between nozzle interior 71 and reservoir attachment 52, allowing any water within reservoir 50 to flow through the reservoir attachment, into the nozzle interior 71, out through tubes 44 and through tube perforations 45.

The valve mechanism embodiment of FIG. 6 is different from the preferred embodiment in that water is drawn by the force of gravity from refillable reservoir 50 through reservoir channels 88 and valve channels 86. No tubes are included in this embodiment to enlarge the "raining" area; the "rain" here falls directly onto an area beneath the reservoir. When the supply of water in reservoir 50 is exhausted the umbrella stops "raining" until the reservoir is refilled.

Other embodiments of the raining umbrella are contemplated which incorporate a battery or solar powered pump to pull water up into the handle from a pool or large body of water. It is also noted that the preferred embodiment could easily be simplified into a single umbrella, without a valve, and having either a reservoir or a garden hose attachment, but not both. Another simplified embodiment is contemplated wherein the spokes and perforated tubes are combined into a single element which provides support for the canopy as well as a passageway for diverting water from the handle to the area below the canopy.

These embodiments of the raining umbrella are constructed, where possible, from molded plastic, (for example, the spokes of the preferred embodiment may require the strength of metal) and can be made in a variety of colors. Although described herein as a toy for children, no specific age limit is implied.

Whereas the present invention has been described in detail with specific reference to particular embodiments thereof, it will be understood that variations and modifications may be effected within the spirit and scope of the present invention as hereinbefore described and as defined in the appended claims.

I claim:

1. A play umbrella, comprising:

a hollow handle, having a first end and a second end and an interior;

a plurality of support spokes, attached to and extending radially outward from said hollow handle first end;

a canopy mounted to said plurality of support spokes;

a plurality of hollow, perforated tubes attached to said plurality of support spokes and connected at one end to the interior of said hollow handle; and attachment means for connecting a water supply to said hollow handle second end.

2. Play umbrella of claim 1, further comprising valve means for selectively blocking the interior of said hollow handle between said attachment means and said plurality of hollow, perforated tubes.

3. Play umbrella of claim 1, further comprising pump means for drawing water from the water supply through said attachment means and into said hollow handle.

4. Play umbrella of claim 1, further comprising:

a refillable reservoir mounted to said hollow handle first end and connected to the interior of said hollow handle; and nozzle means for providing a passageway between the interior of said hollow handle and the interior of each of said plurality of hollow tubes.

5. Play umbrella of claim 4, further comprising valve means for selectively blocking the interior of said hollow handle, either between said attachment means and said nozzle means, or between said refillable reservoir and said nozzle means.

6. A play umbrella, comprising:

a handle, having a first end and a second end;

a refillable reservoir mounted to said handle first end;

a plurality of support spokes, attached to and extending radially outward from said handle first end;

a canopy mounted to said plurality of support spokes;

a plurality of hollow, perforated tubes each of said perforated tubes having an interior attached to said plurality of support spokes; and nozzle means for providing a passageway between said refillable reservoir and the interior of each of said plurality of perforated tubes.

7. Play umbrella of claim 6, wherein said handle is hollow, and further comprising valve means for selectively blocking said nozzle between said refillable reservoir and said plurality of perforated tubes.

8. Play umbrella of claim 7, further comprising attachment means for connecting a water supply to said handle first end.

9. Play umbrella of claim 8, further comprising pump means for drawing water from the water supply through said attachment means and into the interior of said handle.

10. Play umbrella of claim 8, further comprising valve means for selectively blocking said nozzle between said attachment means and said plurality of perforated tubes.

11. An umbrella apparatus comprising:

a handle including, at least, a handle first end and a handle second end;

a plurality of support spokes connected to and extending radially outward from said handle first end;

a canopy connected to said plurality of support spokes;

a reservoir means connected to said handle first end for storing liquid; and a delivery means connected to said reservoir means for transferring liquid from said reservoir means to locations under said canopy when said handle first end is oriented above said handle second end;

a plurality of hollow, elongated, perforated tubes connected to said handle first end and located between said canopy and said handle second end, each of said perforated tubes including a plurality of perforations spaced apart along the length of said perforated tube.

12. Apparatus of claim 11, wherein said delivery means includes, at least, a manually operable valve device connected to said reservoir means; and said perforated tubes attached to said valve device.

* * * * *